US006796283B1

(12) United States Patent
Fleury et al.

(10) Patent No.: US 6,796,283 B1
(45) Date of Patent: Sep. 28, 2004

(54) OILING SYSTEM FOR AN INTERNAL COMBUSTION ENGINE

(75) Inventors: Geoffrey James Fleury, Riverview, MI (US); David Walter Kunitz, Dexter, MI (US); Dean Robert Meldrum, Memphis, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/604,052

(22) Filed: Jun. 24, 2003

(51) Int. Cl.[7] ..... F01M 11/06

(52) U.S. Cl. ..... 123/196 R; 123/195 C; 123/41.47

(58) Field of Search ..... 123/196 R, 195 C, 123/41.47, 41.44

(56) References Cited

U.S. PATENT DOCUMENTS 4,479,463 A * 10/1984 Curley et al. ..... 123/195 C
4,615,314 A * 10/1986 Baugh ..... 123/195 C
4,938,184 A 7/1990 Martin et al.
5,601,060 A 2/1997 Smietanski et al.
5,718,196 A * 2/1998 Uchiyama et al. ..... 123/195 C
5,809,963 A * 9/1998 Saito ..... 123/195 C
5,852,991 A 12/1998 Yamamura et al.
6,041,752 A * 3/2000 Van Klompenburg ... 123/195 C
6,058,898 A 5/2000 Freese
6,257,193 B1 * 7/2001 Alpan et al. ..... 123/196 R
6,378,483 B1 * 4/2002 Kato ..... 123/196 R

* cited by examiner

*Primary Examiner*—Henry C. Yuen
*Assistant Examiner*—Jason Benton

(57) ABSTRACT

An oiling system for an internal combustion engine includes a cover for enclosing lower portion of a cylinder block. The cover has an oil reservoir and oil inlet and an integral transfer tube having an outlet which is coupled directly to the inlet of the engine's oil pump.

18 Claims, 2 Drawing Sheets

OILING SYSTEM FOR AN INTERNAL COMBUSTION ENGINE

BACKGROUND OF INVENTION

1. Field of the Invention

The present invention relates to an oiling system for providing lubricating oil to an internal combustion engine.

2. Disclosure Information

During the early automotive age, the designers of oil pans and oil pickups for vehicular internal combustion engines had a relatively straightforward task because little, if any, vehicle hardware intruded upon the envelope of the oil pan. Moreover, oil pumps were frequently mounted above the oil pan sump, so as to simplify the construction of a fabricated pickup tube extending from the bottom of the sump to the oil pump inlet. With the intervention of time, however, modern design requirements have resulted in oil pans which are very large, with some having deep sumps, and with others being subject to the intrusion of structural cross members or suspension components such as tie rods or steering racks. This has resulted in such oddities as oil pans having multiple sumps, with each having its own drain plug. And, the problems of designing oil pickup tubes have multiplied. Another problem inherent with conventional oil pickup tubes is that entrained air tends to get trapped under the tube's inlet, causing increased aeration of the oil.

An oiling system according to the present invention solves problems inherent in conventional oil pan and pickup combinations by providing an integral pickup. This confers a functional advantage because fewer openings are required in the oil pan's baffle or windage tray, so as to further reduce aeration. Moreover, by providing an oil pickup which exits from the bottom of the pan, the oiling system is less prone to problems arising from handling maneuvers.

Although U.S. Pat. No. 6,257,193 discloses an oil pan having a pickup on the bottom, the integral oil tube shown in the '193 patent is entirely within the oil pan and does not present the packaging advantages and inherent design flexibility that result with the present inventive oiling system.

SUMMARY OF INVENTION

An oiling system for an internal combustion engine includes a cylinder block, an oil pump driven by the engine and having a pump inlet, and a cover for enclosing a lower part of the cylinder block. The cover has at least one oil outlet. An oil pickup includes a first pickup portion located outside the cover and in fluid communication with the oil outlet. A second pickup portion has a first segment extending from the pump inlet through a wall of the cover and a second segment extending from the exterior surface of the cover into the interior of the cover. The oil pickup further includes third portion located inside the cover with the third pickup portion extending between the first pickup portion and the second segment of the second pickup portion.

According to another aspect of the present invention, an oil pickup is preferably integrally formed with the engine cover either by casting from metal, or molding from resin. Alternatively, other metallic or non-metallic materials known to those skilled in the art and suggested by this disclosure may be employed for the purpose of practicing the present invention.

According to another aspect of the present invention, an oil pump inlet used in the present oiling system comprises a spud attached to the oil pump, with the spud or inlet being received by an annular seal comprising a part of the second pickup portion. This generally annularly seal preferably comprises a lip seal having a circumferential tension spring for maintaining sealing contact between the seal and the first segment of the second pickup portion.

It is an advantage of the present invention that a wide variety of engine oil pans or oil system covers may be utilized with a single oil pump configuration, because the oil pickup is integrated with the oil pan itself, as opposed to being a bolted on or pressed-in fabricated tube assembly.

It is a further advantage of the present oiling system that a wide variety of engine oil sump or oil system cover geometries may be accommodated so as to permit installation of various alternative componentry such as suspension components, exhaust pipes, and steering drag links and tierods. This may be done without altering the oil passages in the engine block.

It is a further advantage of the present invention that the present oiling system provides superior performance during extreme handling maneuvers and/or uneven ground conditions which would tend to defeat other types of lubricant collection systems.

It is a further advantage of the present invention that the present pickup tube system is immune from problems caused by the separation of conventional fabricated pickup tubes from the oil pump inlet to which the tube is mounted, with corresponding catastrophic engine failure. This situation is sometimes encountered during competition use of motor vehicle engines.

It is a further advantage of the present invention that the present pickup tube system eliminates the need for the separate fasteners which are normally used to retain a fabricating oil pickup. The failure modes associated with such fasteners are also eliminated.

It is a further advantage of the present invention that serviceability of an engine is improved because the oil pan or cover will be more easily removed than would be the case with known oil pickup systems, because the oil pan or lower cover may be removed in a single step, without the necessity of removing the pickup as an intermediate step.

Other advantages, as well as objects and features of the present invention, will become apparent to the reader of this specification.

DETAILED DESCRIPTION

Figure 1:
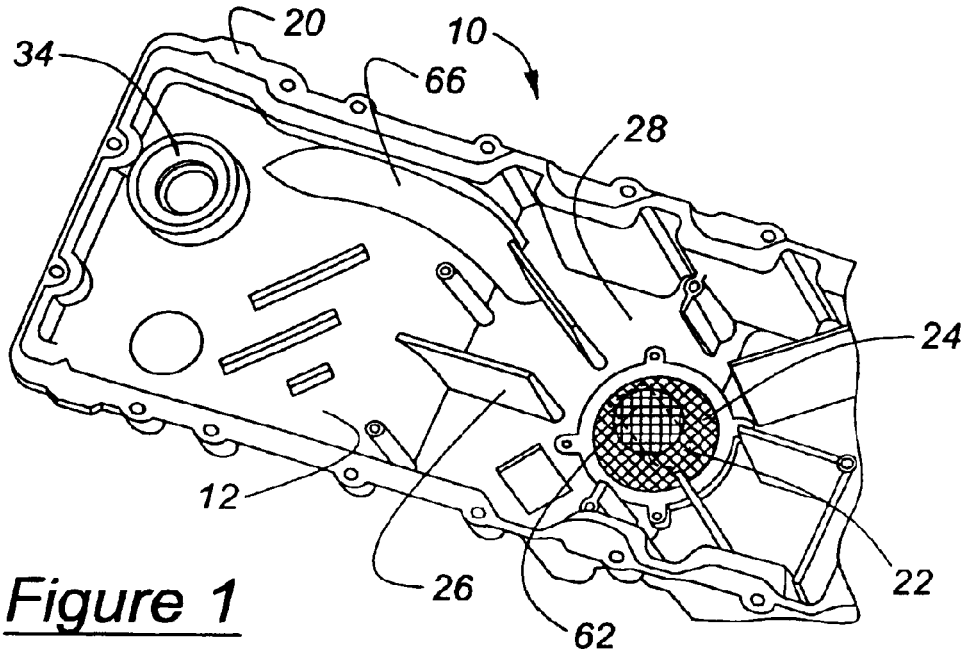
FIG. 1 is a perspective view showing the inside of a lower cover, sometimes termed an "oil pan", of an engine according to the present invention.
Figure 2:
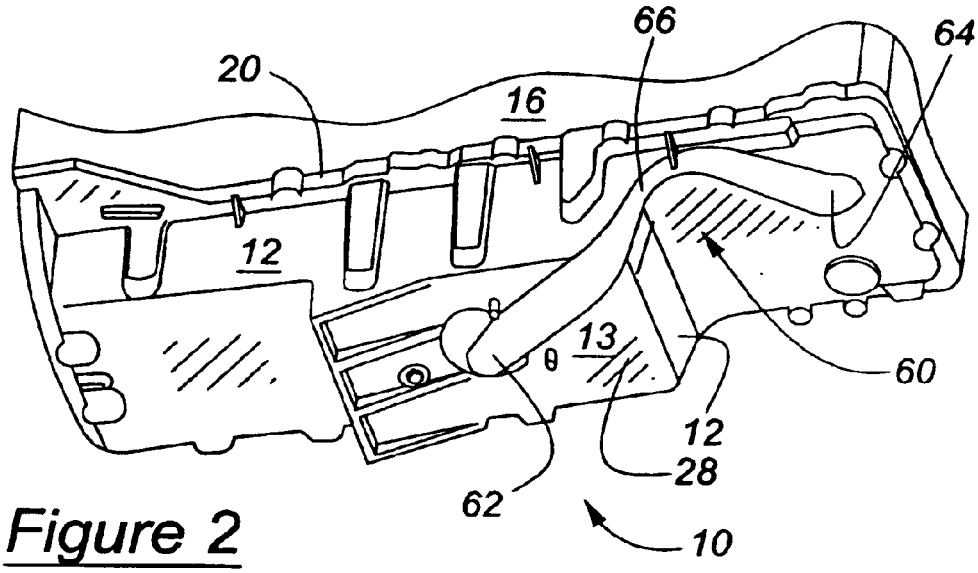
FIG. 2 is a perspective view of the outside bottom portion of the cover of FIG. 1.
Figure 4:
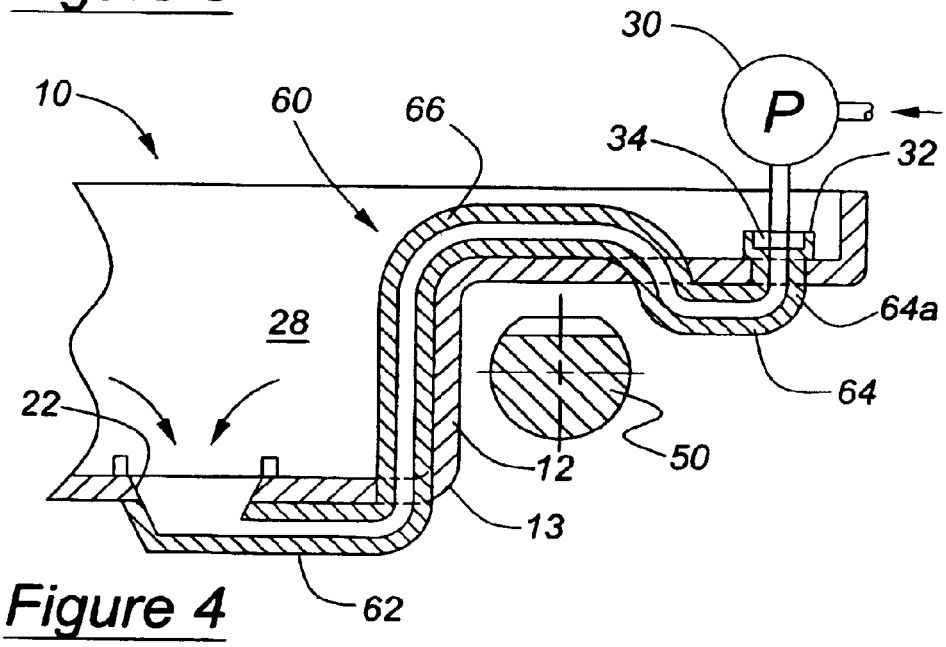
FIG. 4 is a partially schematic sectional view of a cover comprising a portion of an oiling system according to the present invention.

As shown in FIG. 1, lower cover 10 has a variety of oiling system features incorporated therein. Preliminarily, as seen in FIG. 2, lower cover 10 is intended to be mounted upon cylinder block 16 by means of cylinder block flange 20 which bolts onto a mating flange formed on the bottom of a cylinder block 16. Lower cover 10 has sump 28 formed therein. Sump 28 has a plurality of guide vanes 26 formed therein, so as to prevent excessive swirling of oil arising from the withdrawal of oil from sump 28. Sump 28 has oil outlet 22 which is shown in FIGS. 1 and 4. Outlet 22 is preferably formed in the geometric middle of the lower surface of sump 28, but can be relocated for packaging reasons.

Inlet screen 24, having a truncated or frustro-conical shape, is mounted upon oil outlet 22. Because inlet screen 24 is not of conventionally flat construction, screen 24 therefore has much greater surface area, and much less likely to become plugged by foreign matter.

Oil pickup 60 extends from oil outlet 22 to spud 32 which comprises the oil inlet of oil pump 30 (FIG. 4). Oil pickup 60 includes first pickup portion 62 which is integral with an exterior surface 13 of outer wall 12 of lower cover 10. In essence, first pickup portion 62 which can be seen in FIGS. 2 and 4, is preferably cast integrally with the outer wall 12 of lower cover 10. Those skilled in the art will appreciate in view of this disclosure that pickup 60 could alternatively comprise a preformed metal tube which is cast in place with a metallic lower cover, or molded in place, where cover 10 comprises molded resin.

Oil is discharged into oil pump 30 after flowing through second pickup portion 64 of oil pickup 60. Note from FIGS. 2 and 4, that second portion 64 extends along and is integral with the lowest exterior surface of cover 10. This allows a generous bend radius where second pickup portion 64 transitions from horizontal to vertical. This latter section, which is shown at 64*a* in FIG. 4, is immediately upstream of oil pump inlet spud 32.

Third pickup portion 66 extends between first pickup portion 62 and second pickup portion 64. Third pickup portion 66 is located inside cover 10 and, akin to portions 62 and 64, is integral with cover 10. In essence, as best seen in FIG. 4, third pickup portion 66 extends through outer wall 12 of cover 10 in two places. The fact that third pickup portion 66 does extend through outer wall 12 means that steering rack 50 (FIG. 4) may be provided adequate clearance with respect to lower cover 10. Those skilled in the art will appreciate in view of this disclosure that steering rack 50 is merely meant to be exemplary of a whole class of equipment found in and around the engine of a vehicle and needing operating clearance to compensate for incidental movement of the engine upon its mounts. This clearance is facilitated by an oiling system according to the present invention.

Figure 3:
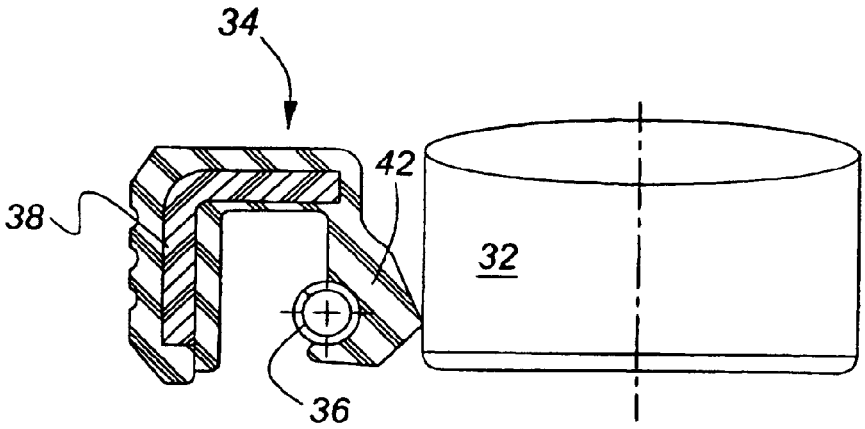
FIG. 3 is a sectional view, partially cut-away, of a seal incorporated into a cover according to the present invention.

FIG. 3 illustrates a seal which is interposed between oil pump inlet spud 32 and a discharge portion of second pickup portion 64. Seal 34, which is positioned as shown in FIGS. 1 and 4, includes an elastomeric lip 42 which is molded in place upon a metallic carrier 38. Garter spring 36, which comprise a metallic tension spring, is positioned about a portion of lip 42 so as to maintain sealing contact with oil pump spud 32. Seal 34 is axially and radially compliant, so as to allow proper assembly of lower cover 10 upon engine block 16 notwithstanding the inevitable tolerance stack-up issues which occur as parts are cast, drilled, milled, tapped, and assembled.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. An oiling system for an internal combustion engine, comprising:

a cylinder block;

an oil pump driven by the engine, and having a pump inlet;

a cover for enclosing a lower part of said cylinder block, with said cover having an oil outlet and an exterior wall; and an oil pickup comprising:

a first pickup portion located generally outside said exterior wall, with said first pickup portion being in fluid communication with said oil outlet;

a second pickup portion having a first segment extending from said pump pickup through said wall to an exterior surface of said cover and a second segment extending along and through said wall into the interior of the cover; and a third pickup portion, located inside said cover, with said third pickup portion extending between said second segment of said second pickup portion and through said wall into fluid communication with said first pickup portion.

2. An oiling system for an internal combustion engine according to claim 1, wherein said oil pickup is integrally formed with said cover.

3. An oiling system for an internal combustion engine according to claim 1, wherein said cover is cast metal and said oil pickup is integrally cast into said cover.

4. An oiling system for an internal combustion engine according to claim 1, wherein said cover is molded resin, with said oil pickup being integrally molded into said cover.

5. An oiling system for an internal combustion engine according to claim 1, wherein said oil pump inlet comprises a spud attached to the oil pump and received within a seal attached to first segment of said second pickup portion.

6. An oiling system for an internal combustion engine according to claim 5, wherein said generally annular seal comprises a lip seal having a circumferential tension spring for maintaining sealing contact between said seal and said oil pump spud.

7. An oiling system for an internal combustion engine according to claim 1, wherein said cover comprises a metallic casting and said oil pickup comprises a metallic tube which is cast in place at the time said cover is cast.

8. An oiling system for an internal combustion engine according to claim 1, wherein said cover comprises molded resin and said oil pickup comprises a metallic tube which is molded in place at the time said cover is molded.

9. An oiling system for an internal combustion engine, comprising:

a cylinder block;

a oil pump attached to the cylinder block and driven by the engine, and having a pump inlet extending downwardly from the oil pump;

a cover for enclosing a bottom portion of said cylinder block, with said cover having an oil reservoir with an oil outlet; and an oil pickup comprising:

a first pickup portion integral with an exterior surface of said cover, with first pickup portion being in fluid communication with said oil outlet;

a second pickup portion extending downwardly through said cover and being in fluid communication with said pump inlet, with said second pickup portion further extending along and integral with an exterior surface of said cover; and a third pickup portion, located inside said cover and extending through said cover into fluid communication with said first pickup portion and said second pickup portion, with said third pickup portion being integral with said cover.

10. An oiling system for an internal combustion engine according to claim 9, further comprising an axially and radially compliance seal positioned between said oil pump inlet and said first pickup portion.

11. An oiling system for an internal combustion engine according to claim 10, wherein said axially and radially compliance seal comprises an elastomeric lip seal.

12. An oiling system for an internal combustion engine according to claim 10, wherein said axially and radially compliance seal comprises an annular elastomeric lip seal having a circumferential metallic tension spring for maintaining sealing contact between said seal and said oil pump inlet.

13. An oiling system for an internal combustion engine according to claim 9, wherein said cover comprises cast metal.

14. An oiling system for an internal combustion engine according to claim 9, wherein said cover comprises molded resin.

15. An oiling system for an internal combustion engine according to claim 9, further comprising a filter screen mounted within said reservoir for screening oil passing from said reservoir into said oil outlet.

16. An oiling system for an internal combustion engine according to claim 9, further comprising a plurality of flow guiding vanes applied to the interior surface of the reservoir contained within said cover.

17. An oiling system for an internal combustion engine according to claim 9, wherein said cover comprises cast metal, with said oil pickup being integrally cast with said cover.

18. An oiling system for an internal combustion engine according to claim 9, wherein said cover comprises molded resin, with said oil pickup being integrally molded with said cover.

* * * * *